US009533506B2

(12) United States Patent
Kraus et al.

(10) Patent No.: US 9,533,506 B2
(45) Date of Patent: Jan. 3, 2017

(54) CONTAINER HANDLING MACHINE FOR PRINTING ONTO CONTAINER

(71) Applicants: KRONES AG, Neutraubling (DE); HEIDELBERGER DRUCKMASCHINEN AG, Heidelberg (DE)

(72) Inventors: Andreas Kraus, Lappersdorf (DE); August Peutl, Woerth/Donau (DE); Andreas Sonnauer, Woerth (DE); Gunnar Behrens, Kiel (DE); Jörg Suhr, Rickert (DE)

(73) Assignee: KRONES AG, Neutraubling (DE)

( * ) Notice: Subject to any disclaimer, the term of this patent is extended or adjusted under 35 U.S.C. 154(b) by 54 days.

(21) Appl. No.: 14/470,603

(22) Filed: Aug. 27, 2014

(65) Prior Publication Data

US 2015/0062240 A1 Mar. 5, 2015

(30) Foreign Application Priority Data

Sep. 4, 2013 (DE) ..... 10 2013 217 685
Sep. 4, 2013 (DE) ..... 10 2013 217 686

(51) Int. Cl.
*B41J 2/165* (2006.01)
*B41J 3/407* (2006.01)
*B41F 17/28* (2006.01)

(52) U.S. Cl.
CPC ..... *B41J 2/16552* (2013.01); *B41F 17/28* (2013.01); *B41J 2/165* (2013.01); *B41J 3/4073* (2013.01); *B41J 2002/16555* (2013.01)

(58) Field of Classification Search
CPC ..... B41J 2/16552; B41J 2/165; B41J 3/4073; B41F 17/28
See application file for complete search history.

(56) References Cited

U.S. PATENT DOCUMENTS 6,206,498 B1 * 3/2001 Kondo ..... B41J 2/16508 347/30
2005/0225007 A1 * 10/2005 Lai ..... B29C 67/0081 264/308
2006/0250464 A1 * 11/2006 Sheinman ..... 347/101
(Continued)

FOREIGN PATENT DOCUMENTS

DE 102006052154 A1 5/2008
DE 102007050490 A1 4/2009
(Continued)

OTHER PUBLICATIONS

German Search Report for Application No. 102013217686.4, dated Apr. 30, 2014.
(Continued)

*Primary Examiner* — Sarah Al Hashimi
(74) *Attorney, Agent, or Firm* — Marshall, Gerstein & Borun LLP

(57) ABSTRACT

Container handling machine for printing onto containers with a transport device optionally configured as a carousel for transporting said containers, with direct printing heads and with a cleaning device for cleaning the direct printing heads, the cleaning device including at least one cleaning unit for dispensing cleaning fluid to a direct printing head and a collection device for discharging spent cleaning fluid.

22 Claims, 9 Drawing Sheets

(56) References Cited

U.S. PATENT DOCUMENTS

| | | | | |
|---|---|---|---|---|
| 2009/0073213 | A1* | 3/2009 | Iwata | B41J 2/16588 347/19 |
| 2012/0125528 | A1* | 5/2012 | Orlandi et al. | 156/184 |
| 2012/0255450 | A1* | 10/2012 | Till | 101/38.1 |
| 2013/0182036 | A1* | 7/2013 | Park | B41J 2/16508 347/30 |
| 2014/0028771 | A1* | 1/2014 | Yamada et al. | 347/104 |

FOREIGN PATENT DOCUMENTS

| | | | |
|---|---|---|---|
| DE | 102009058219 | A1 | 6/2011 |
| DE | 102010020958 | A1 | 11/2011 |
| DE | 102012005087 | A1 | 10/2012 |
| EP | 1967372 | A1 | 9/2008 |
| JP | 2012232771 | A | 11/2012 |
| WO | WO-2010/130397 | A1 | 11/2010 |
| WO | WO-2012/147695 | A1 | 11/2012 |

OTHER PUBLICATIONS

German Search Report for Application No. 102013217685.6, dated Apr. 30, 2014.

European Search Report for Application No. 14183248.5, dated Mar. 19, 2015.

* cited by examiner

CONTAINER HANDLING MACHINE FOR PRINTING ONTO CONTAINER

CROSS-REFERENCE TO RELATED APPLICATIONS

The present application claims priority to German Application Nos. 102013217685.6 and 102013217686.4, filed Sep. 4, 2013. The priority applications, DE 102013217685.6 and DE 102013217686.4, are hereby incorporated by reference.

FIELD OF THE DISCLOSURE

The invention relates to a container handling machine for printing onto containers, a device for printing onto three-dimensional objects, and a method for cleaning the printing stations in a container handling machine.

BACKGROUND

It is known that containers, such as bottles or cans, can be provided with an imprint for identification of the container content, where the printing ink is at a printing station by use of a direct printing head applied directly onto the container. The containers are for this purpose transported in the container handling machine by use of a transport device and the direct printing heads print onto them in a two-dimensional manner. Such a direct printing head is, for example, an inkjet printing head comprising a plurality of typically vertically arranged nozzles (for example, 500-1000). A rotational motion of the container about its longitudinal axis and/or a pivotal motion of the printing head is typically performed for two-dimensional printing. The printed image itself is available as digital information in a computer controller and is used for respective actuation of the direct printing head, the container receptacles and/or a pivot unit. Furthermore, the printing ink is in a subsequent curing device curved with UV or electron beams by cross linking. Several printing units with different printing inks (printing colors) are provided for multi-color printing. It is with such direct printing methods possible to provide the container with an individual print.

The drawback here is that the fine nozzles of the direct printing heads can occasionally clog with printing color and/or contaminants, where already a single clogged nozzle causes a significant error in the print result. Furthermore, it is possible that scattered radiation of the curing device unintentionally cures excess ink on the direct printing head.

To this end, DE 10 2009 058219 A1 suggests that direct printing heads be cleaned by using a cleaning device in regular cycles. The printing head to be cleaned is there in a cleaning position mechanically dabbed off by a dabbing device and/or excess printing ink is removed by an extraction device.

The disadvantage here is that highly dried or partially cured ink residues must be removed with a respectively strong mechanical action of the dabbing device and the nozzles can thereby be damaged. Furthermore, particles can also be introduced by the dabbing device into the non-clogged nozzles and clog them.

It is furthermore known from DE 10 2006 052154 A1 that printing ink is for cleaning purposes jetted from the ink-jet printing head so as to flush the nozzle from the inside.

A disadvantage is that a relatively large amount of printing ink is consumed by this cleaning process and the distribution of the ink used as cleaning fluid is not uniform at the printing head. Furthermore, highly dried or cured ink residue on the printing head can with this method be difficult to remove.

SUMMARY OF THE DISCLOSURE

The object of the present disclosure is therefore to provide a cleaning device for a container handling machine with printing stations with which reliable and inexpensive cleaning of the printing stations is ensured.

As used herein, references to printing stations refer to printing mechanisms or printing heads, respectively, in particular direct printing heads of the printing stations. The term direct printing head is hereinafter also used for printing station.

Due to the fact that a cleaning agent, in particular, cleaning fluid is applied to the direct printing head from the outside, it can be distributed particularly uniformly on the latter's surface and all areas of the direct printing head relevant for printing can therefore be cleaned reliably with the cleaning fluid. It is further by selection of the cleaning fluid possible to remove the highly dried or cured ink residues and thereby remove them reliably from the direct printing head. In addition, cleaning requires no printing ink but comparatively inexpensive cleaning fluid. The cleaning fluid draining from the printing head during the cleaning process is further collected by the collection device and can be disposed of in an environmentally friendly manner or be recycled. Consumption of cleaning fluid is therefore particularly low and correspondingly inexpensive.

Moreover, the chemical and/or physical properties of the cleaning fluid are independent of the printing ink and can therefore be adapted to an optimum cleaning process.

The container handling machine can be arranged in a beverage processing plant. The container handling machine can be arranged downstream of a capper and/or a bottling plant for filling a product into the containers. The container handling machine, however, can also be upstream of the filling process and/or be directly downstream of a container manufacturing process.

The containers can be provided to receive beverages, hygiene products, pastes, chemical, bio-logical and/or pharmaceutical products. The container can generally be provided for any flowable or fillable media. The containers can be made of plastic, glass and metal, but also hybrid containers with material mixtures are conceivable.

The transport device can be configured to move, to rotate and/or fixedly position the containers at a predetermined printing position during printing relative to the direct printing head. The transport device can be adapted to move the container perpendicular and/or parallel to a direction of printing of the direct printing head. The transport device can be adapted to move the print area of the container surface substantially perpendicular to a direction of printing of the direct printing head. "Direction of printing of the direct printing head" can presently mean that this is the direction in which print droplets are dispensed from the direct printing head. The transport device can comprise container receptacles that are optionally formed as being rotatable. The container receptacles can during printing be moved via a movement unit.

The direct printing head can operate with an ink-jet printing method in which the printing ink is dispensed by a plurality of print nozzles onto the container. "Ink-jet printing method" can mean that a sudden pressure increase is created in the chambers of a print nozzle via a piezo-electric or thermal element such that a small amount of print fluid is forced through the print nozzle and dispensed as a droplet onto the container. The direct printing head can have a plurality of print nozzles be arranged along a linear line that is optionally disposed parallel to the container axis. The direct printing head can comprise a number of print nozzles in a range of 100 to 10,000, optionally, in a range from 500 to 1000 nozzles. However, any other direct printing method is conceivable.

The cleaning device can be connected to a supply and/or discharge line for cleaning fluid. The cleaning unit can comprise a nozzle for dispensing the cleaning fluid. The cleaning device can further comprise a pump and/or a valve for controlling cleaning fluid dispensing. The pump and/or valve can be actuatable via an electronic control device and/or by a machine controller. The collection device can be formed like a channel or a basin. The collection device can further comprise a drain hole which is connected to the discharge line for the cleaning fluid. The collection device can be connected to a pump and/or valve. This allows for accelerating and/or controlling drainage of the cleaning fluid. Furthermore, the collection device can be connected to an extraction device.

The cleaning fluid can be water-based or solvent-based. The cleaning fluid can be of such nature that it dissolves dried and/or cured ink and/or forms a chemical bond therewith.

The cleaning unit can further comprise a blow nozzle for air and/or a wiping device. The direct printing head can with the blow nozzle be particularly well dried and/or freed from dry contaminants. Furthermore, the blow nozzle can be connected to a line for air supply. The contaminants partially dissolved by the cleaning fluid can be wiped off the direct printing head particularly well by the wiping device. The cleaning fluid can furthermore be distributed particularly evenly on the direct printing head using the wiping device. The wiping device can be formed as a lip made of a resilient material, such as rubber. The wiping device can be used in combination with an extraction nozzle (54) disposed therebelow.

The cleaning device can be configured as a protective element for the direct printing head, optionally comprising a circumferential seal and/or a protective cap. The direct printing heads can therewith be protected particularly well against having the printing ink dry when the machine is at a standstill. The protective element can be formed corresponding to the direct printing head such that, in a protected arrangement of the direct printing head, a hermetically sealed chamber is formed in the region of the print nozzles.

The cleaning device can be configured to simultaneously clean at least two direct printing heads disposed above each other using cleaning units corresponding to these direct printing heads, where the cleaning units are optional arranged in a step-like manner. In other words, multiple cleaning units for dispensing the cleaning fluid can be arranged one above the other so that the two direct printing heads can be cleaned simultaneously. Particularly efficient cleaning of multiple direct printing heads is possible in this manner. Due to the step-like configuration of the cleaning unit, the spent cleaning fluid does not flow from the upper direct printing head across the lower direct printing head, but into a collection device disposed between the two. The cleaning device can comprise one or more collection devices. The collection devices can also be configured in a step-like manner corresponding to the cleaning units.

The cleaning device for cleaning can be introducible into a container receptacle at the transport device in place of a container. Very little space is in the normal operation mode thereby required for the cleaning device. The cleaning device can be designed in an autarkic manner having a tank with cleaning fluid, a valve and/or with a pump. The cleaning device can thereby be designed in an autarkic manner without supply lines to the container handling machine.

A movement unit can be configured to position and/or move the direct printing head and the cleaning device relative to each other. It is here conceivable that the direct printing head and/or the cleaning device be moved by the movement unit. For example, by moving the cleaning device up and down relative to the direct cleaning head, the cleaning fluid can be applied and distributed particularly evenly along the nozzle arrangement. Furthermore, it is thereby possible to move the wiping device and/or the blow nozzle and/or the extraction nozzle along the direct printing head.

The movement unit can be configured to pivot the direct printing head relative to a horizontal direction of printing in a vertical direction of cleaning such that the nozzles of the direct printing head are for the cleaning process substantially oriented downwardly towards the center of the earth. By orienting the direct printing heads towards the center of the earth, the ejected printing ink and/or the cleaning fluid do not flow along the direct printing head, but are immediately separated by gravity. The horizontal direction of printing can presently mean that this is the direction of dispensing the printing droplets when printing onto the containers Horizontal can also mean that this is a direction perpendicular to the direction towards the center of the earth. The vertical direction of cleaning can be parallel to gravity.

The cleaning device and the direct printing heads can be disposed in a stationary manner on the machine. This allows one or more direct printing heads to be associated with one cleaning device and cleaning can be performed very quickly and thereby efficiently. Furthermore, particularly simple provision of the direct printing heads with printing ink is possible due to the stationary arrangement of the direct printing heads. The movement unit can be configured to position the cleaning device sequentially in succession at several consecutive direct printing heads and to clean them. "Stationary" can presently mean that the cleaning device and the direct printing heads are fixedly connected to a non-movable machine component. "Stationary" can also mean that the cleaning device and the direct printing heads do not circulate along with the transport device.

The cleaning device can be connected to the transport device running along with it and the direct printing heads can be arranged in a stationary manner on the machine. The cleaning device can thereby for cleaning be moved particularly easily by the transport device sequentially in succession to different direct printing heads. The design of the container handling machine is thereby particularly inexpensive. The cleaning device can be disposed between two container receptacles.

The direct printing heads can be connected to the transport device running along with it and the cleaning device can be arranged in a stationary manner on the machine. As a result, multiple direct printing heads can likewise be sequentially moved by the transport device in succession past the cleaning device and be cleaned.

The cleaning device can be arranged at an empty segment of the transport device with container receptacles that are empty during operation. In this manner, the transport device can simultaneously transport containers for printing and the currently not printing direct printing heads can be cleaned in the sections of the empty segment when passing. The empty segment can be arranged in the direction of transport between a discharge and an infeed for containers. The discharge and the infeed can respectively be a discharge and an infeed star.

The cleaning device and the direct printing heads can be connected to the transport device running along with it, where the direct printing heads are optionally arranged star-like around the container receptacles. "Running along" can mean that the cleaning device or the direct printing heads, respectively, are moved along together with the container receptacles by the transport device in a circulating manner.

In addition, the object can be satisfied by a device for printing onto three-dimensional objects, with a first printing unit comprising at least a first nozzle row for ejecting ink droplets, where the ink droplets are ejected substantially in the horizontal direction and where the first printing unit is during a printing mode disposed in a printing position and at least one first area of an object is imprinted, where a cleaning unit is during the printing mode disposed in a stand-by position, and a drive during a cleaning mode generates a relative motion between the cleaning unit and the printing unit, where the relative motion is substantially in the vertical direction.

The invention provides a device for printing onto three-dimensional objects, with a first printing unit comprising at least a first nozzle row for ejecting ink droplets, where the ink droplets are ejected substantially in the horizontal direction and where the first printing unit is during a printing mode arranged in a printing position and at least one first area of an object is imprinted, where a cleaning unit is during the printing mode arranged in a stand-by position, comprising a second printing unit comprising a second nozzle row for ejecting ink droplets, and where the ink droplets are ejected substantially in the horizontal direction, and where the second printing unit is during the print mode arranged in a printing position substantially vertical below the printing position of the first printing unit and prints at least onto a second area of the object, where a drive is provided to create a relative motion during a cleaning mode between the cleaning unit and the printing unit, where the relative motion occurs substantially in a vertical direction, where the cleaning unit is in the cleaning mode movable by the drive vertically upwardly to a cleaning position, wherein the first printing unit and/or the second printing unit is in the cleaning mode movable by a further drive horizontally to the cleaning position, and where the first printing unit or the second printing unit is during the cleaning mode movable in the cleaning position vertically up and back down again.

The device for printing onto three-dimensional objects in an advantageous manner allows for a printing unit for printing onto objects to be effectively cleaned in the horizontal direction with little effort. For this, the device for printing onto three-dimensional objects comprises in particular a drive which creates the advantageous relative motion in a substantially vertical direction. The at least one drive can therefore either move the cleaning unit, the printing unit or both. According to a preferred embodiment, the cleaning unit is moved from a stand-by position, which is beyond the print area for the object to be imprinted, in the vertical direction upwardly to a position adjacent to the printing unit. According to a further preferred embodiment, the printing unit is alternatively from the printing position moved vertically downward to a position adjacent to the cleaning unit. It can also according to a further preferred embodiment be provided to additionally move the cleaning unit and/or the printing unit in the horizontal direction.

The drive can be provided as a single or alternatively as several drives. The drive is preferably an electric or pneumatic linear unit, a spindle drive, a belt drive, or a combination thereof.

A preferred development of the device for printing onto three-dimensional objects is characterized in that a second printing unit is provided which comprises at least a second nozzle row for ejecting ink droplets, where the ink droplets are ejected substantially in the horizontal direction, and where the second printing unit is during the printing mode arranged in a printing position substantially vertically above the printing position of the first printing unit and prints onto at least a second area of the object. The second printing unit can also during the printing mode be arranged in a printing position substantially vertically below the printing position of the first printing unit.

It can further also be provided that a third printing unit is provided which prints onto a third area of the object closing a gap between the first and the second area. It is possible by this so-called stitching to also seamlessly print onto larger objects by using multiple printing heads having a limited print width.

According to a further preferred embodiment of the device for printing onto three-dimensional objects, it is provided that the drive moves the cleaning unit in the cleaning mode vertically upwardly to a cleaning position. In this, the space in front of the printing heads, which is freely accessible outside the printing mode, is used in advantageous manner. The cleaning unit therefore moves from below upwardly to a position that was previously in the printing mode occupied by the object and in the cleaning mode thereby passes into a position from which it can clean the nozzle row of the printing head.

A further preferred embodiment of the device for printing onto three-dimensional objects can be characterized in that a further drive in the cleaning mode moves the first printing unit and/or the second printing unit horizontally to the cleaning position. It is in this manner possible, for example, to bring the cleaning unit and the printing heads in relative positions to each other by their successively or simultaneously occurring motions in the vertical or horizontal direction, so that the cleaning unit with its cleaning elements is disposed directly opposite the respective nozzles of the printing heads or that the nozzles are located in the operative region of the cleaning elements, respectively.

A further advantageous embodiment of the device for printing onto three-dimensional objects can be characterized in that the first printing unit or the second printing unit are during the cleaning mode in the cleaning position moved vertically up and down again. In this manner, for example, a cleaning element of the cleaning unit, such as a wiper, in particular a rubber lip, can be guided along the printing head and clean ink from it.

A further preferred embodiment of the device for printing onto three-dimensional objects can be characterized in that the first printing unit and the second printing unit each comprise a front plate having a receiving opening and a nozzle plate, where the nozzle plate is located recessed in the receiving opening of the front plate. The advantage of this embodiment of the invention is to be seen in the nozzle plate not being contacted by a wiper when the wiper sweeps over the front plate of the cleaning the unit. Only the surface of the front plate is therefore cleaned by the wiper. Any damage to the sensitive nozzles can in this way be prevented. The nozzle plate is recessed preferably approximately 0.1-0.5 mm, particularly preferably approximately 0.2 mm.

A further advantageous embodiment of the device for printing onto three-dimensional objects can be characterized in that the cleaning unit as cleaning elements comprises a wiper for wiping off the front plates, a spray nozzle for spraying cleaning fluid onto the front plate and the nozzle plates, an extraction nozzle for sucking away the cleaning fluid and a pan for collecting the cleaning fluid. The wiper is preferably made of ink-resistant rubber and has a non-adhesion coating (EPDM and Teflon). The spray nozzle can be a hollow cone nozzle, a flat jet nozzle, a full cone nozzle, an atomizer nozzle and other nozzles.

A further advantageous embodiment of the device for printing onto three-dimensional objects can be characterized in that the front plates each comprise a drip edge, where the drip edge is arranged or formed in the vertical direction at the lower end of the respective front plate. This has the advantage that ink can with the wiper on the front plate of the printing head be moved downwardly, and that ink drops of ink form at the lower end of the front plate at the drip edge and detach from the front plate. Such drops of ink can, for example, be collected in the pan of the cleaning unit and removed therefrom.

A further advantageous embodiment of the device for printing onto three-dimensional objects can be characterized in that the cleaning unit comprises at least one cover plate for covering a nozzle plate during an idle mode. Covering a nozzle plate of an ink-jet printing head is commonly referred to as capping. The cleaning unit advantageously comprises at least one cover plate, preferably even two cover plates to effectively protect one or even both printing heads from drying out during the idle mode. The two cover plates can preferably be arranged offset in the horizontal direction.

A plant or machine for conveying three-dimensional objects, preferably a bottling plant, can additionally be characterized by the fact that a device as described above is provided, where the device is integrated into a conveying stretch of the plant or machine.

The device can very well and easily be integrate into the plant or machine because no pivot mechanism needs to be provided like in prior art.

It is understood that the above-described features of the container handling machine with the above-described features of the device for printing onto three-dimensional objects are possible in any combination. The device for printing onto three-dimensional surfaces can also be the container handling machine for printing onto containers.

In addition, the invention provides a method for cleaning direct printing heads in a container handling machine, where the containers are in the normal operation mode imprinted in particular with a direct print and at least one direct printing head is in a cleaning operation mode cleaned with a cleaning device, characterized that, for example, cleaning fluid is in the cleaning operation mode applied by a cleaning unit onto the direct printing head and the spent cleaning fluid and/or contaminant is removed from a collection device.

Due to the fact that the cleaning fluid is in the cleaning operation mode applied by the cleaning unit onto the direct printing head, the surfaces to be cleaned can be cleaned particularly uniformly and, on the other hand, ink residues that are dried or cured can be partially dissolved and removed particularly well. Furthermore, less printing ink is consumed due to the use of the cleaning fluid, whereby cleaning is less expensive. It is ensured by the collection device that the spent cleaning fluid does not flow away across other direct printing heads, whereby they would otherwise become contaminated. The cleaning fluid being collected in the collecting device can furthermore be disposed of in an environmentally friendly manner or be recycled.

The cleaning device can in the cleaning operation mode wipe off the direct printing head and/or blow it clear with air, where the direct printing head optional ejects printing ink. By wiping it off, contaminants or ink residues that are difficult to dissolve can be removed particularly very. Furthermore, by use of air, dry particles can be blown off or the direct printing head can be dried after being cleaned. If the direct printing head ejects printing ink during cleaning operations, contaminants in the print nozzle can be pressed out by the printing ink, whereby the direct printing head is cleaned particularly reliably.

A subset of the direct printing heads can in the normal operation mode be printing and a different subset of direct printing heads is cleaned in the cleaning operation. Normal printing operations must therefore not be interrupted during cleaning and printing can further continue at a constant output.

Furthermore, all of the features mentioned above can be combined individually or in random combinations with the methods disclosed herein.

Further features and advantages of the invention shall be explained below with reference to embodiments illustrated in the Figures, in which:

DETAILED DESCRIPTION OF THE PREFERRED EMBODIMENTS

Figure 1:
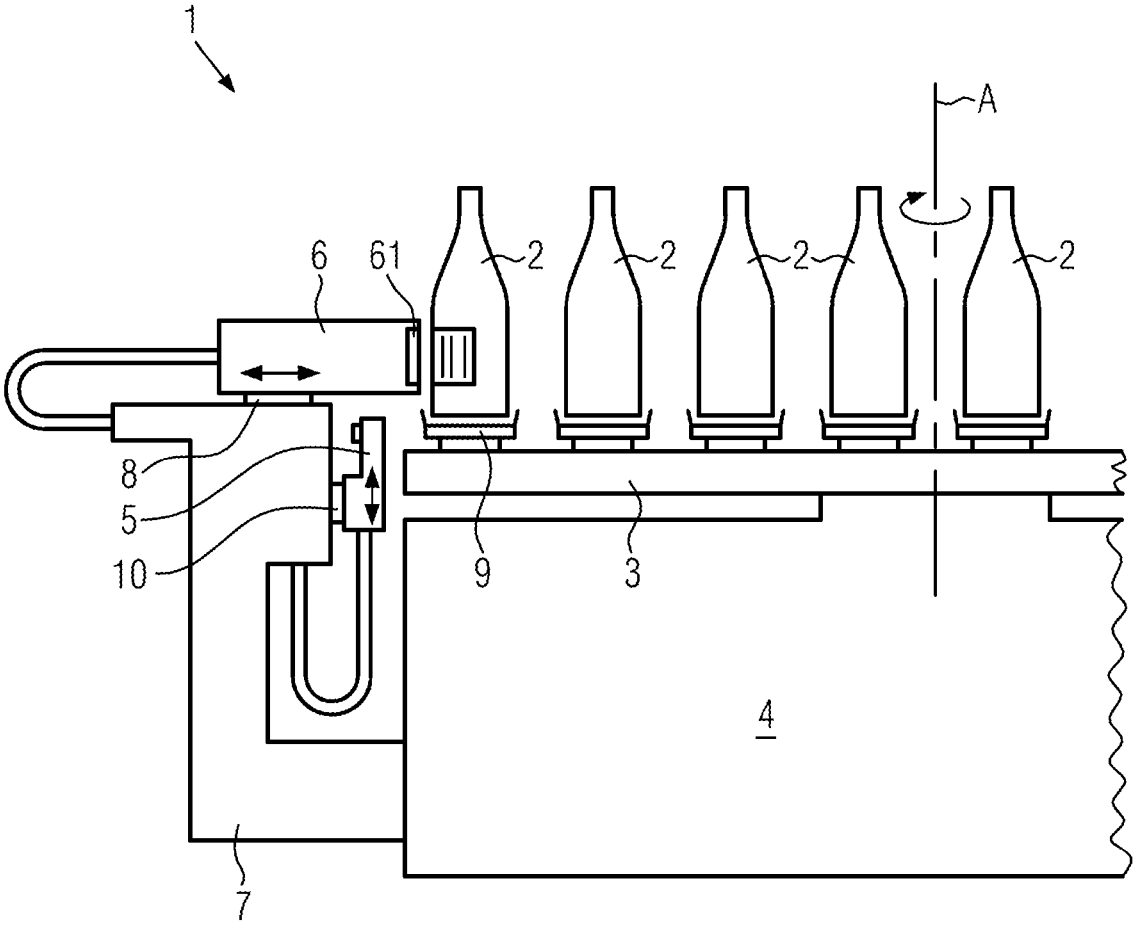
FIG. 1 shows a representation of a first embodiment of a container handling machine for printing onto containers in a side view.

FIG. 1 shows a first embodiment of a container handling machine 1 for printing onto containers 2 in a side view. A transport device 3 can been seen configured as a carousel that receives the containers 2 in the container receptacles 9 and passes them by the stationarily arranged direct printing head 6 for being imprinted. Furthermore, the cleaning device 5 can be seen which, as described below with reference to FIGS. 1-3 in more detail, is provided to clean the direct printing head 6.

The carousel 3 is driven by a geared motor or a direct drive (presently not illustrated) such that it rotates about the axis of rotation A. The containers 2 are via an infeed star—presently also not illustrated—placed in the container receptacles 9 and held at the base and at the neck (presently not shown). The container receptacles 9 are further embodied rotatable by geared motors or direct drives, so that the containers 2 can be rotated about their longitudinal axes.

The direct printing head 6 is formed as an ink-jet printing head. However, any other digital direct printing technology is also conceivable. The direct printing head presently shown comprises multiple print nozzles 61 (for example, 500) in a linear line at the side facing the carousel axis A which can apply ink droplets onto the container surface. A two-dimensional print can therewith be created by simultaneous rotation of the container 2 about its longitudinal axis.

It can furthermore be seen that the direct printing head 6 is fixedly connected via the support 7 to the machine base 4. The machine base 4 is likewise fixedly connected via a base frame to a plant base (presently not shown), hence the machine base 4 does not rotate with the carousel 3.

Furthermore, the direct printing head 6 can via a first movement unit 8 be moved substantially perpendicular to the axis of rotation A of the carousel. Firstly, the printing distance can thereby be adapted to different container diameters and, secondly, the direct printing head 6 can be moved to a cleaning position (see FIG. 3).

It can furthermore be seen that the cleaning device 5 is via a second movement unit 10 attached to support 7. It can be moved up and down substantially parallel to the axis of rotation A of the carousel 3. The set-up of the cleaning device 5 is explained blow in more detail with reference to FIG. 2. Both the direct printing head 6 as well as the cleaning device 5 are connected via respective supply lines to the support 7. These lines are flexible.

Figure 2:
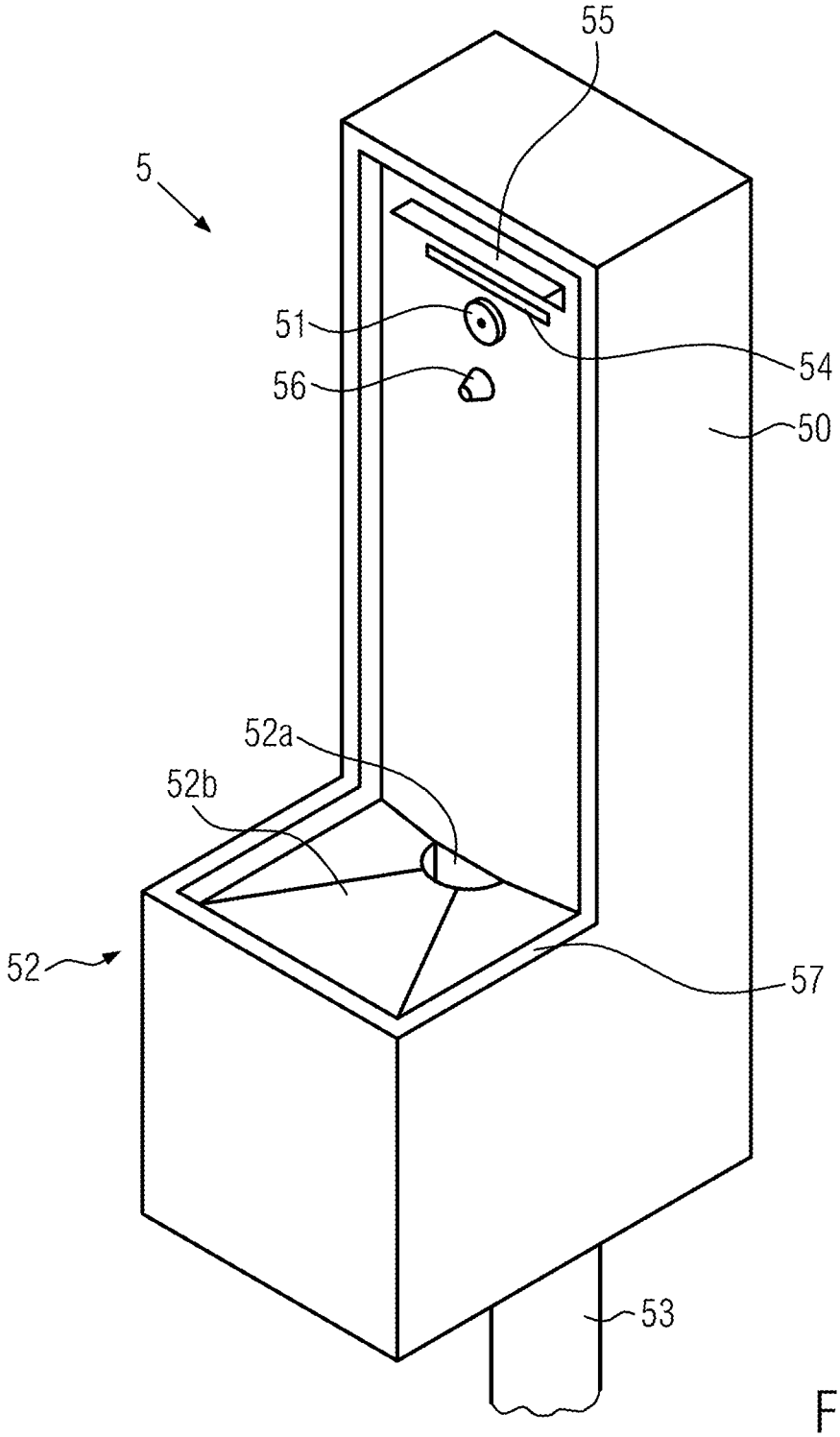
FIG. 2 shows a representation of a cleaning device in a perspective view.

FIG. 2 shows a representation of a cleaning device 5 in a perspective view. It can be seen that the cleaning device 5 has a substantially L-shaped housing, where the cleaning unit 51, the blow nozzle 56, the wiping device 55 and the extraction device 54 are integrated in the leg extending vertically during cleaning operations. The collection device 52 is disposed below the cleaning unit 51 in the region of the housing 50 which during cleaning operations extends substantially horizontally The collection device 52 comprises a basin-like (funnel-shaped) element 52*b* which guides the dripping cleaning fluid into the drain 52*a*. This allows the spent cleaning fluid to be disposed of or recycled in an ecologically friendly manner Furthermore, the cleaning device 5 is supplied with cleaning fluid and air and the spent cleaning fluid as well as the contaminant residues sucked in by the extraction device 54 are removed via the supply line 53.

It can further be seen that a circumferential seal edge 57 is formed at the cleaning device 5. It is made of a soft rubber seal. The cleaning device 5 can during standstill of the machine be moved and positioned in direct contact with the printing head 6. This results in a closed chamber around the nozzles 61, so that they are protected from contamination and drying out.

Figure 3:
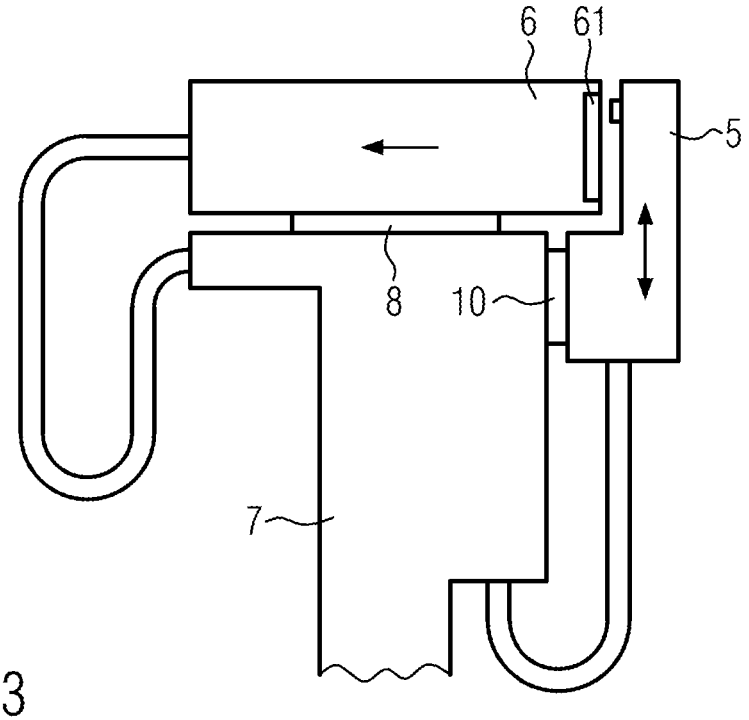
FIG. 3 shows a representation of a direct printing head and a cleaning device of the first embodiment in a side detailed view.

FIG. 3 shows a representation of a direct printing head 6 and a cleaning device 5 of the first embodiment in a side detailed view. In this, the direct printing head 6 is cleaned with the cleaning device 5. The cleaning device 5 is during cleaning operations used as follows:

For starting cleaning operations, the direct printing head 6 is first moved to the left by the first movement unit 8 along the direction of the arrow. Furthermore, the cleaning device 5 is via the second movement unit 10 positioned upwardly in front of the nozzles 61. The printing head is then by use of the movement unit 8 moved to the right to a distance from the cleaning unit necessary for the cleaning procedure.

During the actual cleaning process, the cleaning fluid is now by the cleaning unit 51 illustrated in FIG. 2 (formed as a nozzle) sprayed onto the print nozzles 61 and their adjacent areas. Cleaning fluid is distributed uniformly along the height of the direct printing head 6 due to an up and down motion of the cleaning device 5 caused by the second movement unit 10 or due to an up and down motion of the printing head, respectively.

The spent cleaning fluid in FIG. 3 drains downwardly and is collected and discharged from the collection device 52 shown in FIG. 2.

The surface of the nozzle plate 61 and/or the housing of the direct printing head 6 can additionally be wiped off with the wiping device 55 and printing ink components 55 that are difficult to dissolve and/or have cured can thus be mechanically removed therefrom.

Air is ejected from the blow nozzle 56 for drying the direct printing head 6 and simultaneously the cleaning device 5 or the printing head is moved up and down. The fluid parts thus removed from the direct printing head 6 are then sucked in by the extraction device 54. In addition, dry contaminants can also be blown off.

Figure 4:
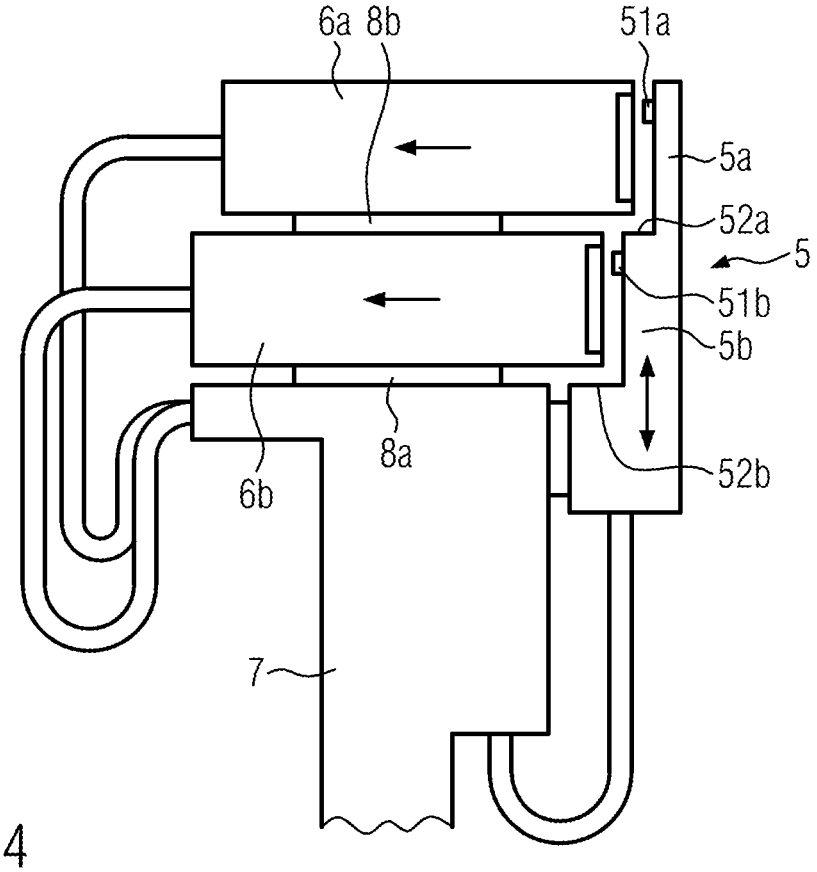
FIG. 4 shows a representation of a cleaning device for simultaneous cleaning of two direct printing heads disposed above each other in a side detailed view.

FIG. 4. shows a representation of a cleaning device 5 for simultaneous cleaning of two direct printing heads 6*a* and 6*b* disposed above each other in a side detailed view. It differs from the first embodiment only by the additional direct printing head 6*a* and the configuration of the cleaning device 5.

The direct printing heads 6*a*, 6*b* are moveable independently of each other by the two movement units 8*a* and 8*b* and print areas disposed above one another on the container 2 shown in FIG. 1 can therefore be imprinted simultaneously.

The cleaning device 5 in FIG. 4 differs from the one shown in FIG. 2 in that it is formed with two sections 5*a* and 5*b* disposed above each other in a step-like manner. Each of the two sections 5*a* and 5*b*, except for the housing, can be formed like the cleaning device 5 in FIG. 2 and integrated into a common housing.

Section 5*a* there comprises cleaning unit 51 with which cleaning fluid can be sprayed onto the direct printing head 6*a*. The spent cleaning fluid subsequently drains downwardly and is collected in the collection device 52*a* so that it does not drain across the second direct printing head 6*b* disposed therebelow. It is further to be seen that the second section 5*b* can comprise the cleaning unit 51*b* with which cleaning fluid can be sprayed onto the direct printing head 6*b*. The spent cleaning fluid now draining therefrom is collected by the collection device 52*b*.

The two direct printing heads 6*a* and 6*b* disposed above each other can be cleaned simultaneously with the cleaning unit 5 designed in this manner.

Figure 5:
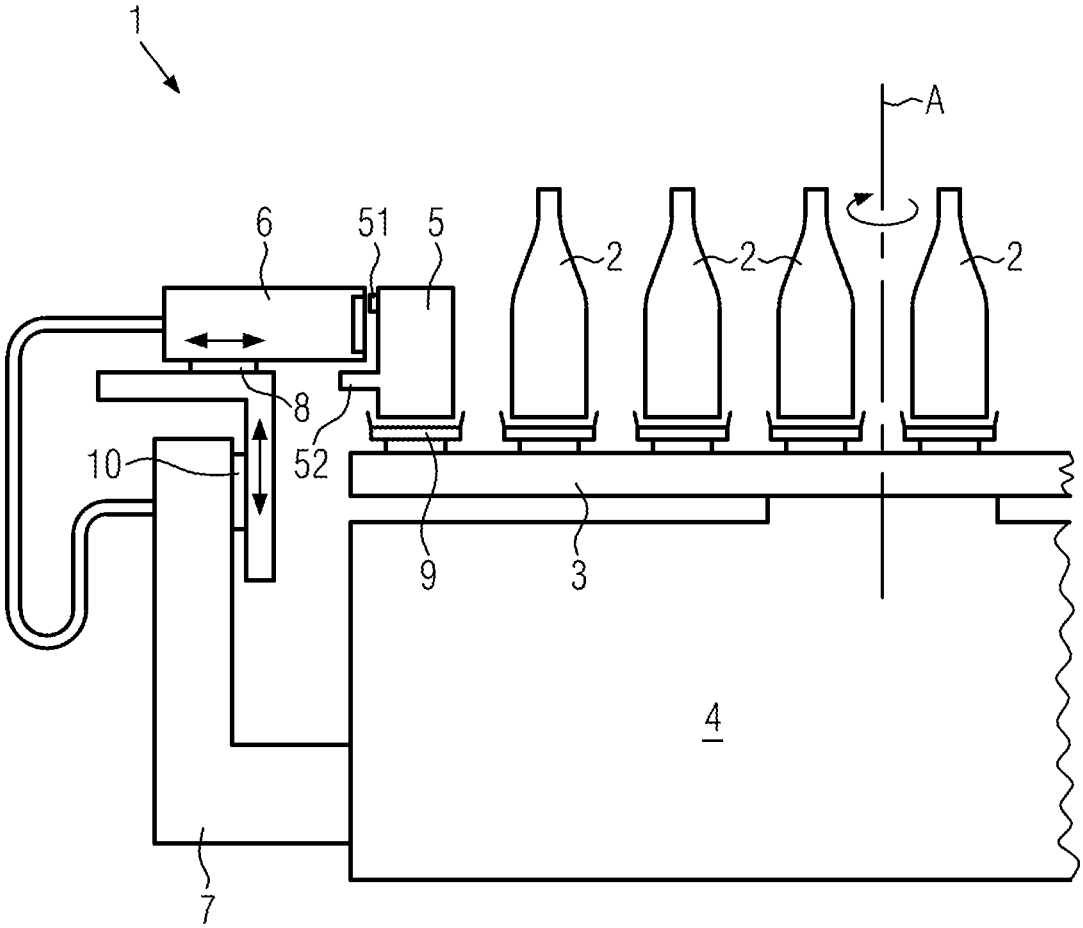
FIG. 5 shows a representation of a second embodiment of a container handling machine for printing onto containers in a side view.

FIG. 5 shows a representation of a second embodiment of a container handling machine 1 for printing onto containers 2 in a side view. It differs from the first embodiment essentially in that the cleaning device 5 is connected to the transport device 3 (also designed as a carousel) running along with it. This allows the cleaning device 5 to sequentially clean further direct printing heads 6 (presently not shown) in succession.

The direct printing head 6 can be moved with the first and second movement unit 8, 10 both perpendicular as well as parallel to the axis of rotation A. This allows the direct printing head 6 to be moved to a printing position or to a cleaning position.

The cleaning device 5 also comprises a cleaning unit 51 and a collection device 52 which are disposed similarly as in FIG. 2 in an L-shaped manner relative to each other. This allows for cleaning fluid to be sprayed onto the direct printing head 6 and for spent cleaning fluid to be collected. It can further be seen that the cleaning device 5 is formed as an insert for the container receptacle 9 and comprises a storage tank with a pump, presently not shown. The cleaning device 5 can therewith be without any supply lines to the carousel 3. One embodiment is also conceivable, however, in which the cleaning device 5 is inserted into a container receptacle 9 and connected to supply lines. It is furthermore conceivable that at least one container receptacle 9 comprises a plug connection for supplying the cleaning device 5.

The transport device 3 is during cleaning moved such that the cleaning device 5 is disposed opposite from the printing head 6. The direct printing head 6 is then initially moved in the horizontal direction with the first movement unit 8 to an extent that a favorable distance for cleaning arises. Furthermore, the direct printing head 6 is with the second movement unit 10 moved up and down such that the direct printing head 6 can in the vertical direction be wetted with cleaning fluid over as much of the entire surface as possible.

It is possible in the second embodiment shown in FIG. 5 to clean all direct printing heads 6 with a single cleaning device 5. The container handling machine 1 is thereby designed to be particularly inexpensive.

Figure 6:
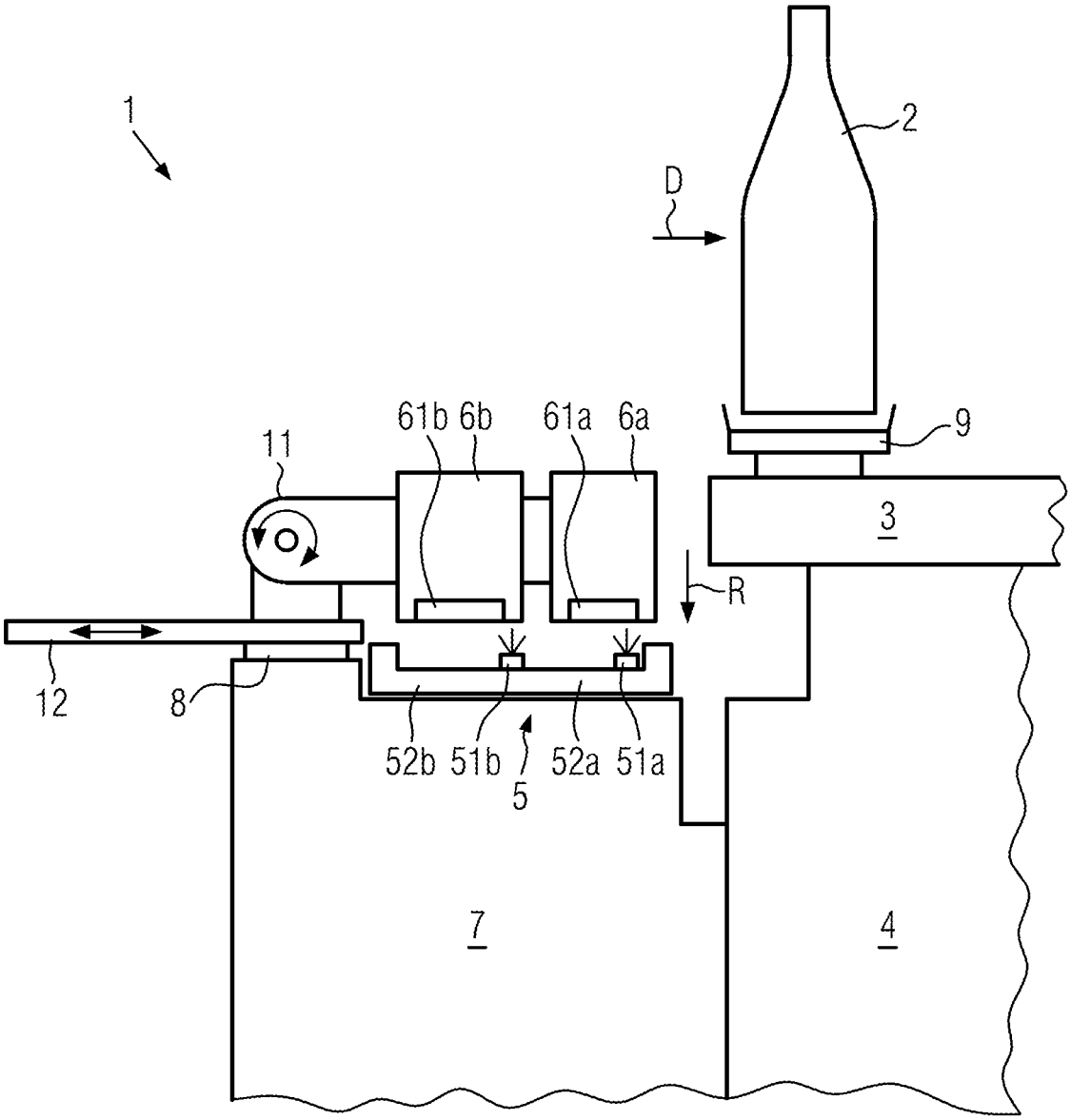
FIG. 6 shows a representation of a third embodiment of a container handling machine for printing onto containers in a side view.

FIG. 6 shows a representation of a third embodiment of a container handling machine 1 in a side view. The third embodiment is distinguished from the one shown in the second embodiment in FIG. 5 essentially in that the direct printing heads 6*a* and 6*b* disposed above each other when printing can jointly be pivoted by a pivot unit 11 or by one pivot unit for each printing head form a substantially horizontal direction of printing D to a vertical direction of cleaning R.

It can furthermore be seen that the containers 2 are received in the container receptacles 9 by use of the transport device 3. The transport device 3 is there likewise designed as a carousel and rotates about an axis of rotation—presently not shown—relative to the machine base 4.

The two printing heads 6*a* and 6*b* are during printing arranged in a printing position—presently not shown—above each other. The two direct printing heads 6*a* and 6*b* there dispense ink droplets in the direction towards the direction of printing D onto the container 2. Due to the fact that two direct printing heads 6*a* and 6*b* are presently disposed above each other, two printing sections of the container can be printed simultaneously.

It can further be seen in FIG. 6 that the direct printing heads 6*a* and 6*b* are stationary, i.e. fixedly arranged at the machine base 4.

For cleaning, the direct printing heads 6*a* and 6*b* are moved by the movement device 8 as far away as possible from the edge of the carousel 3. The direct printing heads 6*a* and 6*b* are via the pivot device 11 connected to a base plate 12 which simultaneously serves to cover the cleaning device 5 during normal operation (printing operation).

The direct printing heads 6*a* and 6*b* are by the pivot device 11 during the cleaning process pivoted by 90° such that the print nozzles 61*a* and 61*b* are in the direction of cleaning R aligned downwardly.

The cleaning device 5 presently comprises two cleaning units 51*a* and 51*b* and two collection devices 52*a* and 52*b*, respectively, that during cleaning correspond with the direct printing heads 6*a* and 6*b*. It is thereby possible to simultaneously spray onto the direct printing heads 6*a* and 6*b* and to collect and discharge the spent cleaning fluid with the collection devices 52*a* and 52*b*. The two collection devices 52*a* and 52*b* can also be formed jointly as one collection device (such as a channel). In this, the direct printing heads 6*a* and 6*b* can individually or jointly be move horizontally or the cleaning device 5 itself is moved in its entirety or individual parts of the cleaning device 5 can be moved, for example only nozzle 61*a* and 61*b*.

Furthermore, the print nozzle 61*a* and 61*b* during the cleaning process eject printing ink, whereby they are cleaned particularly well. The ejected printing ink does not get onto other areas of the direct printing heads 6*a* and 6*b* due to the fact that the nozzles 61*a* and 61*b* are during the cleaning process aligned downwardly, i.e. in the direction of gravity.

Figure 7:
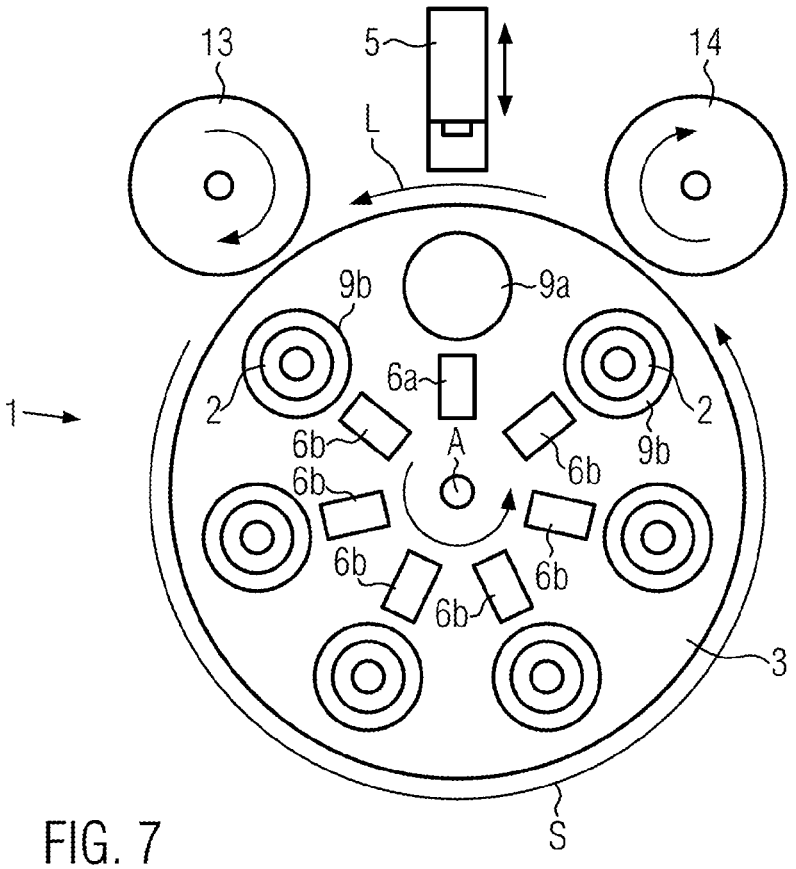
FIG. 7 shows a fourth embodiment of a container handling machine for printing onto containers in a top view.

FIG. 7 shows a representation of a fourth embodiment of a container handling machine 1 in a top view. It can be seen that the containers 2 are in the container handling machine 1 via the infeed star 13 placed onto the transport device 3 configured as a carousel 3 in the container receptacles 9*b* and transported along the transport stretch S. The direct printing heads 6*b* which are connected to the transport device 3 running along with it are used for printing. The transport device 3 configured as a carousel 3 rotates about the axis of rotation A continuously or in a clocked manner. Furthermore, the imprinted containers 2 are then discharged from the discharge star 14. Also several carousels can alternatively be directly lined up together along a direction of transport without transfer stars. The container receptacles 9*a* are empty in the region of the empty segment L (in the direction of transport between the discharge star 14 and the infeed star 13) and the non-active direct printing head 6 can there be cleaned by the fixedly arranged cleaning device 5. For this, the cleaning device 5 is moved in the direction of the axis of rotation A to the direct printing head 6*a*, so that it is situated immediately opposite from it.

Due to the fact that the cleaning device 5 cleans the non-active direct printing head 6*a* in the region of the empty segment, printing operations of the container 2 do not need to be interrupted for cleaning.

Figure 8:
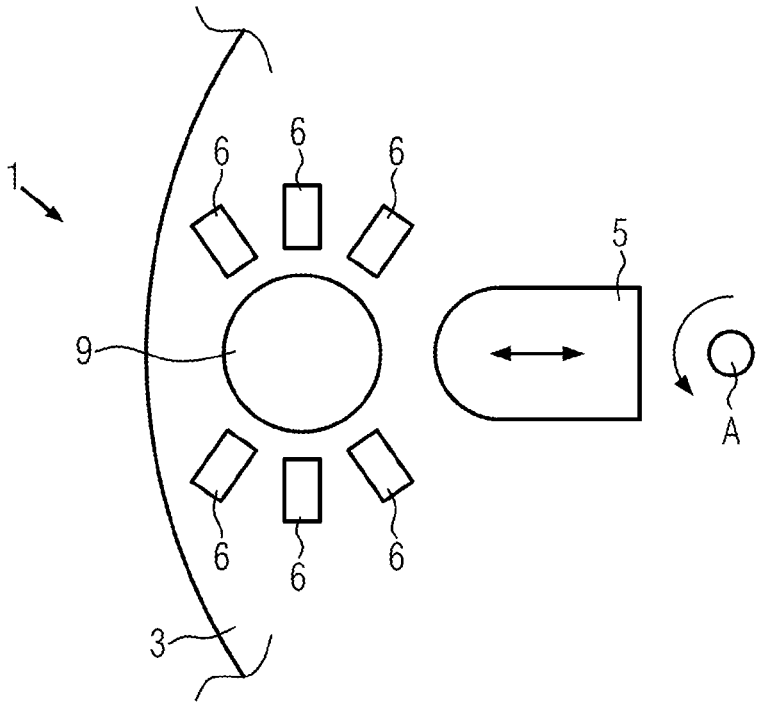
FIG. 8 shows a fifth embodiment of a container handling machine for printing onto containers in a top view.

It is also conceivable in this embodiment that each printing head is associated with one cleaning device in a co-rotating manner. FIG. 8 shows a representation of a fifth embodiment of a container handling machine 1 for printing onto containers 2. The transport device 3 is there also configured as a carousel rotating about the axis of rotation A. The container receptacles 9, the direct printing heads 6, and the cleaning device 5 are there connected to the carousel 3 running along with it. It is possible with the empty container receptacle 9 presently shown to move the cleaning device 5 for cleaning along the double arrow. The cleaning device 5 there also comprises cleaning units—not shown—and collection devices for the cleaning fluid.

Figure 9:
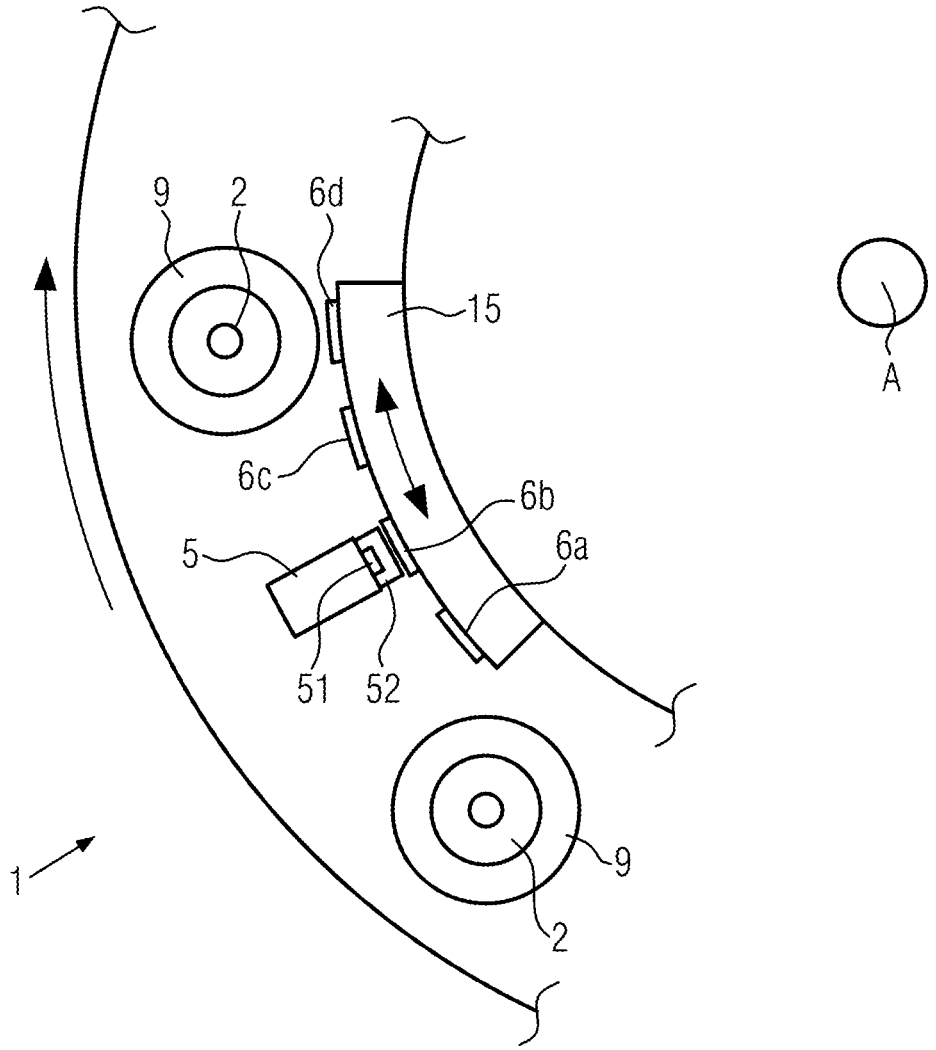
FIG. 9 shows a representation of a sixth embodiment of a container handling machine for printing onto containers in a top view.

FIG. 9 shows a sixth embodiment of a container handling machine 1 for printing onto containers 2 in a top view. The transport device 3 can be seen configured as a carousel 3 rotating about the axis of rotation A. Container receptacles 9, with which the containers 2 are transported, are formed at the carousel 3. In addition, it can be seen that the direct printing heads 6a-6d are connected via a movement unit with the carousel 3 running along with it. The direct printing heads 6a-6d presently exhibit different printing colors.

The containers 2 are for printing rotated by drives in the container receptacles 9 about their longitudinal axis. A specific direct printing head 6d can at the same time be positioned via the movement unit 15 at the container 2 to print onto the latter with a specific printing color. The movement unit 15 then moves another of the direct printing heads 6a-6d to the container 2 and printing is effected with a further printing color.

Between two container receptacles 9, there is the cleaning device 5 with a cleaning unit 51 located at the carousel 3 for dispensing the cleaning fluid and a collection device 52 for discharging the spent cleaning fluid.

The cleaning device 5 is employed as follows: a direct printing head 6b presently not needed is moved to the cleaning device 5. Cleaning fluid is then by use of the cleaning device 5 sprayed onto the direct printing head to be cleaned. The cleaning device 5 can at the same time be moved up and down (parallel to the axis of rotation A). The direct printing head 6b to be cleaned is thereby wetted as uniformly as possible with the cleaning fluid. The draining cleaning fluid is then collected by the collection device 52 and discharged.

The cleaning devices 5 shown in FIGS. 5-9 are formed substantially like the cleaning device 5 illustrated in FIG. 2. They can therefore also comprise a blow nozzle 56, a wiping device 55, and an extraction device 54. The cleaning device 5 can furthermore be configured as a protective element for a direct printing head 6 when the machine 1 is at a standstill.

Figure 10:
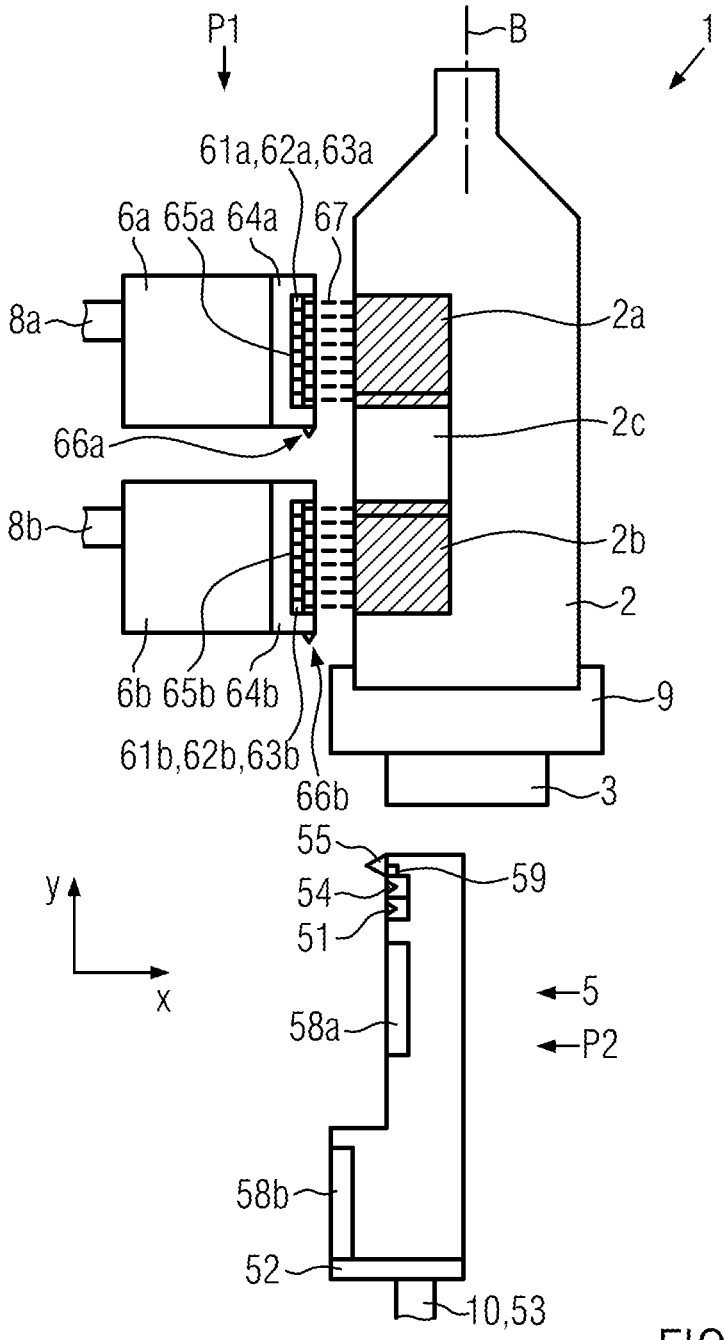
FIG. 10 shows a schematic side view of a seventh embodiment of the device according to the invention in the print mode.

FIG. 10 shows a machine with a device 1 for ink-jet printing onto a three-dimensional object 2. The object 2, e.g. a hollow body like a bottle or any other container, is placed on an object carrier 9 and moved together with the object carrier 9 on a conveying stretch 3, for example, a carousel.

FIG. 10 also shows a first printing head 6a and a second printing head 6b as printing units which print onto areas on the surface of the object 2. The object 2 is there aligned vertically, i.e. its longitudinal axis B extends substantially parallel to a Y-direction (the vertical direction), and the two printing heads 6a and 6b are aligned substantially horizontally, i.e. the droplets 67 ejected by them move substantially parallel to an X-direction (the horizontal direction). Each printing head 6a and 6b has an ink supply (not shown).

The first printing head 6a prints onto an area 2b on the surface of the object 2 and the second printing head 6b onto an area 2a. The two areas do not directly connect to each other, but are due to the design of the printing heads 6a and 6b spaced from each other in the vertical direction. A third printing head—not shown in FIG. 10—is therefore located (relative to the image plane) behind the two printing heads 6a and 6b and prints onto the surface of the object 2 in an area 2c which closes the gaps between areas 2a and 2b and thereby partially overlaps them (so-called stitching).

The two printing heads 6a and 6b are during a printing mode located in a printing position P1 adjacent to the conveying stretch 3, so that the nozzles 61a and 61b of the two printing heads are disposed at a printing distance from the surface of the object 2. The object 2 rotates about its axis B, so that a motion of the printing heads 6a and 6b is during printing not required. Once printing onto the object 2 is completed, the latter is further moved with the object carrier 9 on the conveying stretch 3 and a subsequent object is moved into the print area in front of the printing heads 6a and 6b.

For ejecting the ink droplets 67, the two printing heads 6a and 6b each comprise front plates 64a and 64b with receiving openings 65a and 65b into which the nozzle plates 63a and 63b are integrated. The nozzle plates in turn comprise nozzle rows 62a and 62b. In the example shown, the nozzle rows extend substantially parallel to the vertical direction Y. It is also evident that the nozzle plates 63a and 63b are with the nozzle rows 62a and 62b recessed into the respective front plates 64a or 64b, i.e., are in the horizontal direction X slightly further spaced from the surface of the object 2 than the surface of the respective front plate 64a or 64b. An advantage provided by this recessed integration shall be described in more detail further below.

FIG. 10 also shows that the two printing heads 6a and 6b each comprise a drive 8a and 8b. The printing heads 6a and 6b can with these two drives, as can be seen from a comparison of the three FIGS. 10-12, be moved both in the horizontal direction X as well as in the vertical direction Y.

FIG. 10 furthermore shows that each printing head 6a and 6b at the lower side of its respective front plate 64a or 64b comprises a respective drip edge 66a, 66b. These drip edges can be designed e.g. as sharp protruding edges or as so-called noses. The function and the resulting advantages of the respective drip edges are further explained in more detail below.

A cleaning unit 5 or an automatic cleaning system, respectively, is shown In the lower part of FIG. 10 that is used for cleaning the two printing heads 6a and 6b. The cleaning unit 5 is during the printing mode located in the stand-by position P2 visible in FIG. 10. This stand-by position P2 is preferably located below the conveying stretch 7 and in the horizontal X offset from position P1 of the two printing heads 6a and 6b.

The cleaning unit 5 comprises as cleaning elements a wiper 55, preferably a rubber lip, an extraction nozzle 54, and a spray nozzle 51. Tthe wiper is used for wiping off the front plates 64a and 64b (on which e.g. ink mist can collect), the spray nozzle 51 for spraying cleaning fluid (which preferably contains a solvent for cured ink) onto the front plates 64a and 64b and the nozzle plates 63a and 63b, and the extraction nozzle is used for extracting the cleaning fluid sprayed on from the nozzle plates 63a and 63b (and for drying the front plates 64a and 64b). The cleaning fluid can be supplied to the cleaning unit 5 via a hose connection 53—not illustrated. Similarly, the extracted cleaning fluid can together with the cleaned-off ink be removed from the cleaning unit 5 via a likewise not illustrated hose connection. A bypass bore 59 can be provided between the extraction nozzle 54 and the wiper 55 and provides the advantage that ink adhering to the wiper can be sucked away and removed from the cleaning unit 5. The bypass bore 59 can end below, above or in the wiper 55.

The cleaning unit 5 additionally comprises two cover plates 58a and 58b which serve to close the two printing heads 6a and 6b during the idle mode (alternative: so-called capping mode) thereby preventing the nozzles 61a and 61b from clogging due to drying ink. The capping mode is a sub-mode of the cleaning mode.

The cleaning unit 5 finally comprises a collection pan 52. As is evident in particular in FIG. 12, cleaning fluid and ink removed by the wiper 55 is collected in the collection pan 52 and can be discharged from the cleaning unit 5 via a hose connection not shown in FIG. 10. It is alternatively possible to remove the collection pan 52 from the cleaning unit 5, to empty it, and to replace it, preferably in a cleaned state.

The cleaning unit 5 comprises a drive 10 which allows moving the cleaning unit 5 at least in the vertical direction Y. It can optionally be provided that the drive 10 can move the cleaning unit 5 also in the horizontal direction X.

After terminating the print mode and after initiating the cleaning mode, no object 2 and also no object carrier 9 is any longer located in front of the nozzle rows 62*a* and 62*b* of the two printing heads 6*a* and 6*b*. Disruptive elements of the conveying stretch 3 are also moved out of the region in front of the printing heads 6*a* and 6*b*. It is therefore possible to move the cleaning unit 5 from below in the vertical direction Y upwardly and to bring it substantially to the position at which object 3 was previously located. It is alternatively also possible to move the two printing heads 6*a* and 6*b* in the vertical direction Y downwardly to an adjacent position to the cleaning unit 5. Still alternatively, it is possible to move both the cleaning unit 5 as well as the two printing heads 6*a* and 6*b* by using their respective drives in the vertical direction Y and bring them to a position that is adjacent to each other. All three technical solutions, however, are based on a vertical relative motion R1 (cf. FIG. 11) between the two printing heads 6*a* and 6*b* and the cleaning unit 5. Again alternatively, it is possible to move the cleaning unit 5 from below to a sufficiently clear space between the two printing heads 6*a* and 6*b* and the conveying stretch 3. The object 2 can in this case remain in front of the printing heads 6*a* and 6*b*. The two printing heads are optionally previously moved in the horizontal direction X away from the conveying stretch 3 to provide sufficient free space.

Figure 11:
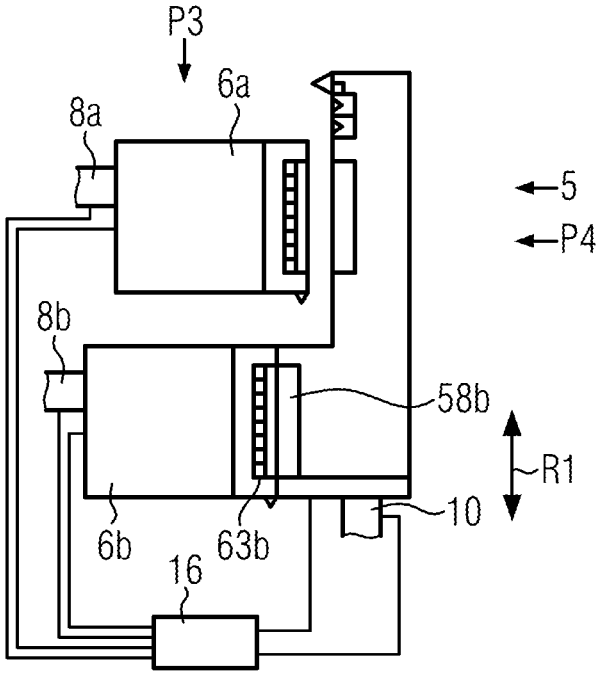
FIG. 11 shows a schematic side view of the seventh embodiment of FIG. 1 in the cleaning mode.

FIG. 11 shows the cleaning unit 5 in a cleaning position P4. The two printing heads 6*a* and 6*b* are likewise shown in the cleaning position P3. FIG. 11 also evidences that the second printing head 6*b* was by use of its drive 8*b* moved in the horizontal direction X so that the second nozzle plate 63*b* is covered by the cover plate 58*b* (so-called capping mode).

Figure 12:
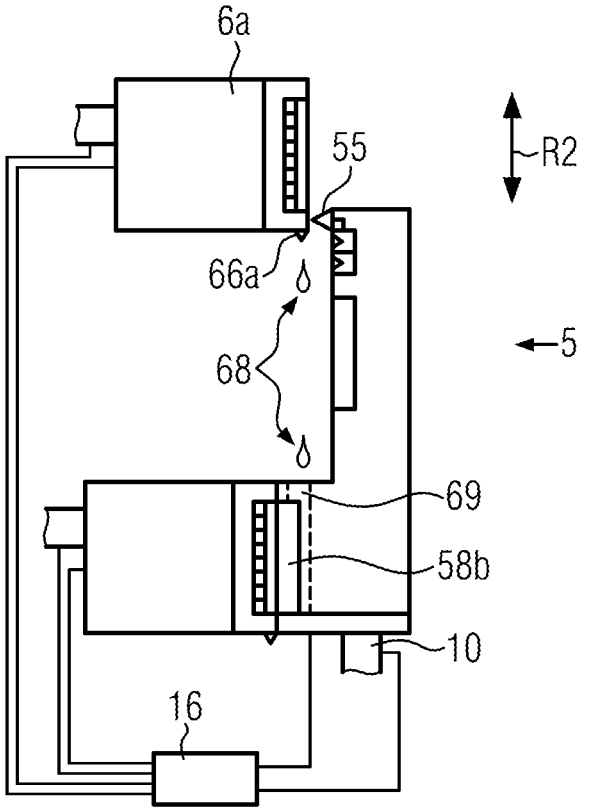
FIG. 12 likewise shows a schematic side view of the seventh embodiment of FIG. 1 in the cleaning mode.

The first printing head 6*a*, however, is not in a capping mode and—as is evident from a comparison of FIGS. 11 and 12—is now subjected to a motion R2 substantially in the vertical direction Y.

FIG. 11 also shows a control unit 16 which is via control interfaces connected to the two printing heads 6*a* and 6*b*, the cleaning unit 5, and the three drives 8*a*, 8*b* and 10. The control unit 16 starts and stops the printing mode and the cleaning mode, starts and stops the three drives 19, 20 and 31 for moving the two printing heads 6*a* and 6*b* and the cleaning unit 5 to their respective positions P1 to P4 , and starts and stops nozzles 54 and 51 arranged on the cleaning unit 5. In addition, the control unit 16 can start and stop ejection of ink droplets. This enables so-called purging, where ink droplets 67 are ejected from the ink supply solely for the purpose of cleaning the nozzles 61*a* and 61*b* and for the removal of gas bubbles.

The first printing head 6*a* is in FIG. 12 shown in an upper position into which it has passed due to the up and down motion R2. By moving the printing head 6*a*, the surface of the first front plate 64*a* is cleaned with the wiper 55 and drops of ink and cleaning fluid 68 by dripping off the drip edge 66*a* pass into a shaft or channel 69 of the cleaning unit 5 and from there downwardly into the pan 52. The shaft 69 is located in the interior of the cleaning unit 5 and in the horizontal direction X behind the cover plate 58*b*. Also the motion R2 recognizable in FIG. 12 of the first printing head 6*a* is started and stopped by the control unit 16.

The control unit 16 can additionally determine the speed and the duration of the cleaning process (for example, how fast and how frequently the wiper 55 is passed over the front plates 64*a* and 64*b*), the amount of cleaning fluid sprayed on, and the duration of the residence time of the cleaning fluid, e.g. in dependence on the ink used and/or the preceding printing process.

Spraying with nozzle 51 and purging are optional steps of the cleaning mode. Spraying occurs with a short puff of about 1 second, the cleaning fluid then acts and purging begins.

Spraying the cleaning fluid can be performed with the use of water-based and UV-inks. Since there can be a risk of drying due to stray ultraviolet light when using UV inks, preventive spraying is preferably already performed, i.e. before nozzle failure is recorded.

Cleaning the second printing head 5 is performed by up and down motions of the second printing head 5 in correspondence to the cleaning process of the first printing head. For this, the first printing head is moved out of the way, i.e. preferably moved yet further upwardly, so that the second printing head can reach the operative region of the cleaning elements 51, 54 and 55.

It is understood that the features mentioned in the embodiments described above are not restricted to these specific combinations and are also possible in any other combination.

What is claimed is:

1. A container handling machine for printing onto containers, comprising:

a transport device configured as a carousel for transporting said containers, with at least one printing station and with at least one cleaning device for cleaning said printing station, wherein said at least one cleaning device and/or said at least one printing station is movable to a cleaning position for cleaning the printing station, wherein said cleaning device comprises a housing, a cleaning unit carried by the housing and comprising a dispensing device for cleaning fluid, and a collection device for at least one of cleaning fluid or printing agent residue or contaminant, wherein said cleaning unit is configured and oriented in said cleaning position such that the cleaning unit can clean a print nozzle of each of said at least one printing station with the print nozzle disposed substantially in a horizontal direction of printing, and wherein said collection device is disposed below said cleaning unit in a region of the housing which in said cleaning position extends substantially horizontally, and wherein, in the cleaning position, the collection device is disposed substantially vertically below the dispensing device such that the collection device collects at least one of cleaning fluid or printing agent residue or contaminant draining from the printing head during the cleaning process.

2. The container handling machine according to claim 1, said cleaning unit comprising at least one of a blow nozzle for air/cleaning fluid a wiping device or an extraction device.

3. The container handling machine according to claim 1, said cleaning device being in a specific position configured as a protective element for said printing station.

4. The container handling machine according to claim 3, the cleaning device including at least one of a circumferential seal or a protective cap.

5. The container handling machine according to claim 1, said cleaning device configured for simultaneously cleaning at least two printing stations disposed above each other using cleaning units corresponding to said printing stations.

6. The container handling machine according to claim 5, the cleaning unit being disposed in a step-like manner.

7. The container handling machine according to claim 1, said cleaning device can for cleaning be inserted into a container receptacle in place of a container at said transport device.

8. The container handling machine according to claim 1, one or more movement units adapted to at least one of position or move a printing station and said cleaning device relative to each other.

9. The container handling machine according to claim 8, where said movement unit is adapted to pivot a printing station relative to a horizontal direction of printing (D) in a vertical direction of cleaning (R) such that said nozzles of said printing station are for cleaning aligned substantially downwardly towards the center of the earth.

10. The container handling machine according to claim 1, and one of: said cleaning device and said printing stations are arranged in a stationary manner at said machine (1);

said cleaning device is connected to said transport device running along with it and said printing stations are arranged in a stationary manner at said machine;

said printing stations are connected to said transport device running along with it and said cleaning device is arranged in a stationary manner at said machine said cleaning device arranged at an empty segment (L) of said transport device with container receptacles that are empty during operations; or said cleaning device and said printing stations are connected to said transport device (3) running along with it, where said printing stations are arranged in a star-like manner around said container receptacles.

11. The container handling machine according to claim 1, in combination with a second printing station that is in a printing position (P1) arranged substantially vertically below said first printing station and prints onto at least one second area (2*b*) of said container.

12. The container handling machine according to claim 11 one of said first printing station or said second printing station being movable during said cleaning mode moved vertically up and back down again.

13. The container handling machine according to claim 11, said first printing station and said second printing station each comprises a front plate with a receiving opening and a nozzle plate, where said nozzle plate is recessed in said receiving opening of said front plate (64*a*, 64*b*).

14. The container handling machine according to claim 13, said front plates each comprise a drip edge said drip edge one of disposed or formed in the vertical direction at the lower end of said respective front plate.

15. The container handling machine according to claim 1, and a movement unit (8*a*, 8*b*) in the cleaning mode moves at least one of said first printing station or said second printing station horizontally to a cleaning position (P3).

16. The container handling machine according to claim 1, where said printing station comprising at least a first nozzle row for ejecting ink droplets, where said ink droplets are ejected substantially in the horizontal direction (X) and where said first printing station is during a printing mode disposed in a printing position (P1) and prints onto at least one first area of a container, where said cleaning device is during a printing mode disposed in a stand-by position (P2), the container handling machine further comprising a further printing station comprising at least a second nozzle row for ejecting ink droplets from which ink drops are ejected substantially in the horizontal direction (X) and where said further printing station is during said printing mode disposed in a printing position (P1) substantially vertically below said printing position (P1) of said first printing station and prints onto at least one second area of said container, where a movement unit is provided to generate a relative motion (R1) during a cleaning mode between said cleaning device and said printing station, where said relative motion occurs substantially in the vertical direction (Y), where said cleaning device can in said cleaning mode be moved by said movement unit vertically upwardly to a cleaning position (P4), where at least one of said printing station or said further printing station can in said cleaning mode be moved by a further movement unit horizontally to said cleaning position (P3), and where said printing station or said further printing station (6*b*) can during said cleaning mode be moved in said cleaning position (P3) vertically up and back down (R2) again.

17. A device for printing onto three-dimensional objects, comprising:

a first printing unit including at least a first nozzle row for ejecting ink droplets, where said ink droplets are ejected substantially in the horizontal direction and where said first printing unit is during a printing mode disposed in a printing position and prints onto at least one first area of an object;

a second printing unit including at least a second nozzle row for ejecting ink droplets, where said ink droplets are ejected substantially in the horizontal direction and where said second printing unit is during said printing mode disposed in a printing position aligned substantially vertically below said first printing unit and prints onto at least one second area of said object;

a cleaning unit, wherein during said printing mode the cleaning unit is disposed in a stand-by position located substantially vertically below the first printing unit and the second printing unit;

a first drive that generates a relative motion during a cleaning mode between said cleaning unit and said printing units, wherein said relative motion is substantially in the vertical direction, and wherein said cleaning unit in said cleaning mode is moved by said first drive vertically upwardly to a cleaning position that is horizontally adjacent to at least one of the first printing unit and the second printing unit; and a second drive that moves at least one of said first printing unit or said second printing unit in said cleaning mode horizontally toward or away from the cleaning unit to said cleaning position, and wherein during said cleaning mode said second drive moves at least one of said first printing unit or said second printing unit in said cleaning position vertically up and back down again.

18. A method for cleaning printing stations in a container handling machine, wherein said containers are imprinted in a normal operation mode and at least one printing station is in a cleaning operation mode cleaned with a cleaning device, the cleaning device comprising a housing, a cleaning unit disposed in the housing, and a collection device disposed in the housing, wherein the collection device, during the cleaning operation mode, is disposed substantially vertically below the cleaning unit in a region that extends substantially horizontally, the method comprising:

disposing the printing station in the cleaning operation mode substantially in a horizontal direction of printing, applying a cleaning agent in the cleaning operation mode by said cleaning unit in a substantially horizontal direction onto said printing stations, and collecting at least one of the spent cleaning agent or a contaminant in the cleaning operation mode with the collection device extending in a substantially horizontal region of said housing, said collection device being disposed substantially vertically below said cleaning unit.

19. A method according to claim 18, further comprising at least one of wiping off, blowing clear or sucking clear said printing stations said cleaning device in said cleaning operation mode.

20. A method according to claim 19, wherein a subset of said printing stations is printing in the normal operation mode, while a different subset of said printing stations is cleaned in the cleaning operation mode.

21. A method according to claim 18, said cleaning device is during printing operations held in a waiting position beyond the print area and is in the cleaning operation mode joined with said printing stations in said cleaning position and can there assume a protective function.

22. The method according to claim 18, and the printing station ejecting ink.

* * * * *